United States Patent [19]

Sup

[11] 4,448,305

[45] May 15, 1984

[54] GOLF BAG INCLUDING STIFFENING STRUCTURE

[75] Inventor: Kim Y. Sup, Busan, Rep. of Korea

[73] Assignee: King Stone Co., Ltd., Busan, Rep. of Korea

[21] Appl. No.: 413,221

[22] Filed: Aug. 30, 1982

[51] Int. Cl.[3] ..... A63B 55/00

[52] U.S. Cl. ..... 206/315.8

[58] Field of Search ..... 150/1.5 R, 1.5 B; 206/315.5, 315.7, 315.8, 315.3; 248/96

[56] References Cited

U.S. PATENT DOCUMENTS

| | | | |
|---|---|---|---|
| 1,444,357 | 2/1923 | Pierce | 150/1.5 B |
| 1,488,389 | 3/1924 | Hibbert | 150/1.5 B |
| 1,498,910 | 6/1924 | Harpham | 150/1.5 R |
| 1,714,759 | 5/1929 | Bloomberg | 150/1.5 R |
| 1,951,158 | 3/1934 | Locke et al. | 150/1.5 R |
| 2,698,040 | 12/1954 | Wilkens | 150/1.5 R |
| 4,378,039 | 3/1983 | Suk | 150/1.5 B |

FOREIGN PATENT DOCUMENTS

| | | | |
|---|---|---|---|
| 574132 | 4/1959 | Canada | 150/1.5 R |
| 180575 | 6/1922 | United Kingdom | 150/1.5 R |
| 468429 | 7/1937 | United Kingdom . | |

*Primary Examiner*—William Price
*Assistant Examiner*—Sue A. Weaver
*Attorney, Agent, or Firm*—William W. Haefliger

[57] ABSTRACT

A lightweight reinforced golf bag construction comprises:

(a) a longitudinally elongated golf bag having an open upper end, a closed lower end, and a flexible wall extending between said ends and about a hollow interior adapted to receive golf club shafts, (b) at least one rod extending longitudinally between said ends and removably retained by the bag adjacent said wall to resist sideward flexing of the wall, and (c) a channel at the closed lower end of the bag and opening longitudinally toward the upper end of the bag, the rod lower end or ends freely received in said channel.

5 Claims, 4 Drawing Figures

GOLF BAG INCLUDING STIFFENING STRUCTURE

BACKGROUND OF THE INVENTION

This invention relates generally to golf bag construction, and more specifically concerns selective reinforcing or stiffening or relatively flexible golf bag walls.

Golf bags are desirably of lightweight, sturdy, simple, flexible construction. Problems that arise include the need for stiffening the bag wall to prevent its endwise collapse as well as lateral or sideward collapse. Such stiffening may undesirably reduce bag wall flexibility, and may involve need for excessively complex or expensive construction.

SUMMARY OF THE INVENTION

It is a major object of the invention to provide an improved golf bag construction which enables selective stiffening of the bag wall, in a very simple and readily accomplished manner, whereby the user can selectively stiffen his golf bag to desired or required extent, both endwise and sidewardly.

Basically, the bag construction comprises:

(a) a longitudinally elongated golf bag having an open upper end, a closed lower end, and a flexible wall extending between said ends and about a hollow interior adapted to receive golf club shafts, (b) a rod or rods extending longitudinally between said ends and removably retained by the bag adjacent said wall to resist sideward flexing of the wall, (c) a channel to freely receive the lower end or ends of the rod or rods.

As will appear, longitudinally elongated retainers such as pockets may be carried by the flexible wall to loosely receive the rods, to guide their insertion so that lower ends of the rods loosely and blindly penetrate a channel at the closed lower end of the bag; and that channel may be formed by a relatively rigid cap at the lower end of the bag, whereby the rods are flexibly movable with the bag wall, to limited extent, but serve to resist endwise and sideward collapse of the bag wall. Further, the rod upper ends may be removably anchored by holders in a relatively rigid annular cap, as will appear.

These and other objects and advantages of the invention, as well as the details of an illustrative embodiment, will be more fully understood from the following specification and drawings, in which:

DRAWING DESCRIPTION

DETAILED DESCRIPTION

Figure 1:
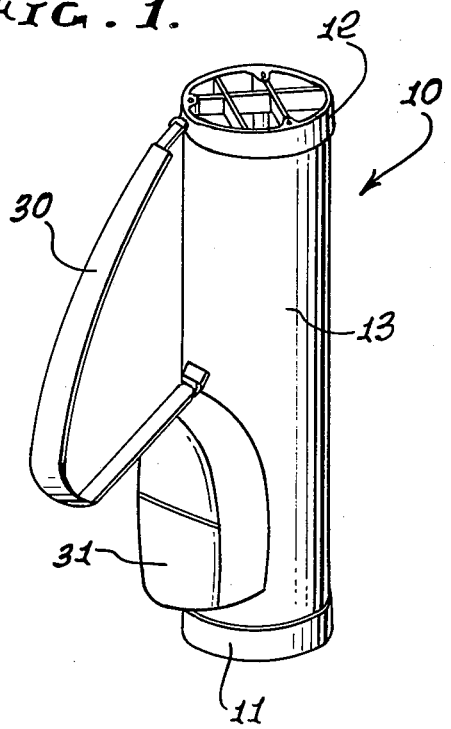
FIG. 1 is a perspective view of a golf bag incorporating the invention.
Figure 3:
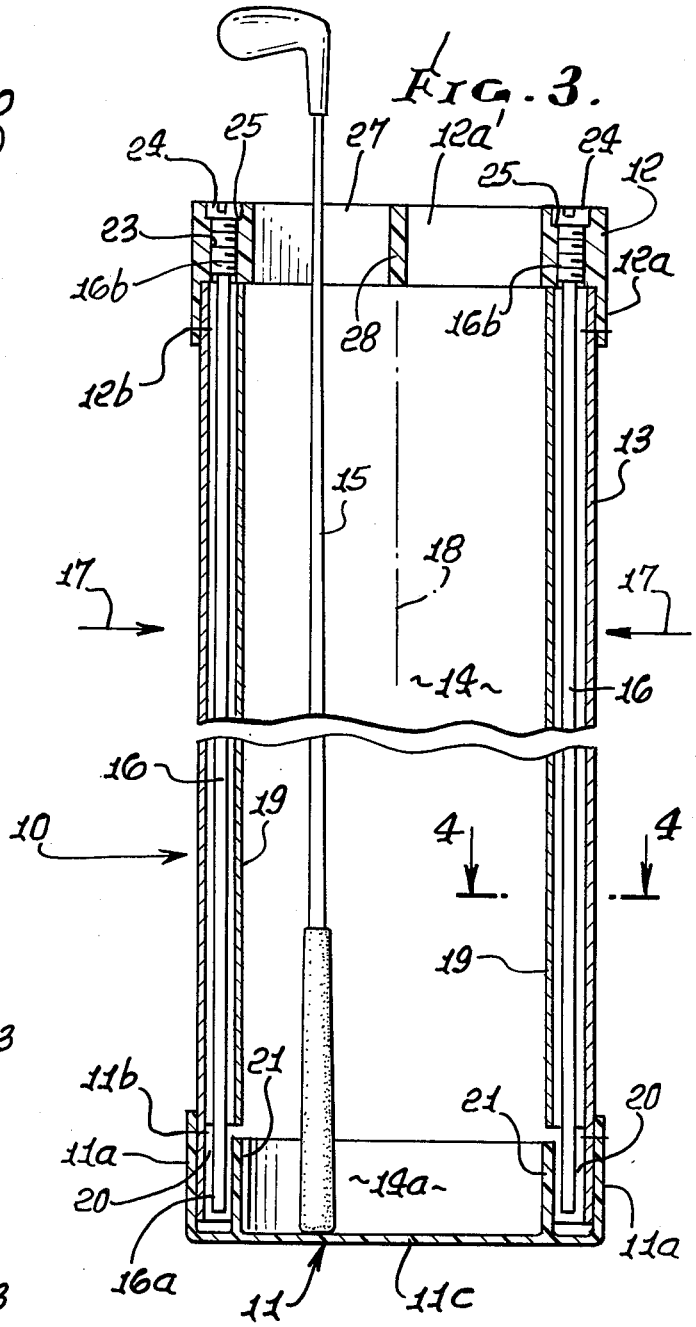
FIG. 3 is an elevation taken in section on lines 3—3 of FIG. 2.
Figure 2:
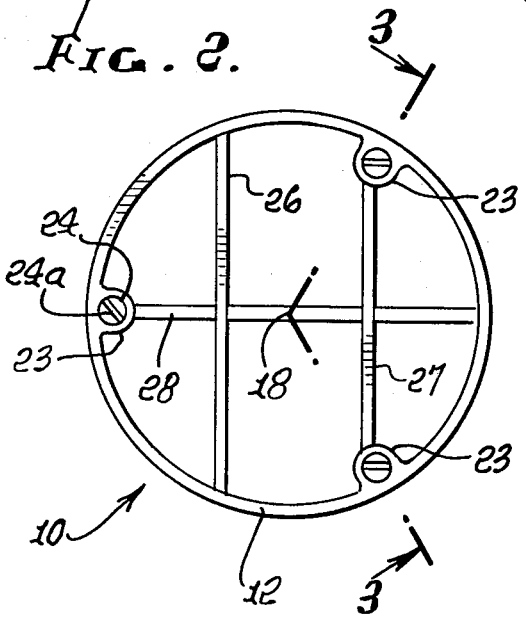
FIG. 2 is an enlarged top plan view of the FIG. 1 bag.

A lightweight golf bag 10 is shown to be longitudinally elongated in an upright direction, in FIGS. 1 and 3; it has a closed lower end defined by lower end cap 11; an open upper end defined for example by upper cap 12 having a central opening 12*a*; and a flexible wall 13 extending about a hollow interior 14 adapted to receive golf club shafts, indicated at 15. The bag wall 13 may for example consist of sheet material, natural or synthetic. The lower and upper caps 11 and 12 are relatively rigid, and have annular skirts 11*a* and 12*a* suitably secured to the generally tubular wall 13, as at 11*b* and 12*b*. The cap may consist for example of relatively rigid plastic material.

In accordance with the invention, one or more reinforcing rods 16 are inserted into the bag to extend longitudinally between the upper and lower bag ends, the rods removably retained adjacent to the wall 13 to resist sideward flexing of the bag wall, while allowing the wall to flex inwardly (see arrows 17) to limited extent in response to sideward force exertion on the bag wall. Also, the rods may hold the flexible bag in longitudinally extended condition, i.e. against endwise collapse. To this end, the rods may consist of lightweight metal, as for example aluminum, and are spaced about the bag axis 18, three such rods being shown, and being adequate, although more may be employed. Selected rods may be removed or added, to vary the bag flexibility, as desired. The rods are relatively stiff, yet resiliently bendable.

Figure 4:
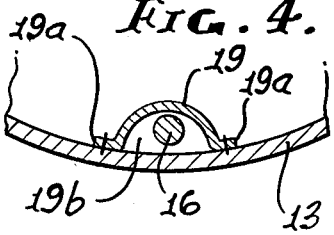
FIG. 4 is an enlarged section on lines 4—4 of FIG. 3.

To retain the rods in position, longitudinally elongated retainers may be provided to be carried by the wall 13, the retainers sized to loosely receive the rods endwise therein and being spaced about the hollow interior of the bag. As shown, each retainer may advantageously take the form of flexible pocket 19, with elongated sides 19*a* attached to the bag wall inner side, as by stitching. FIG. 4 shows the pocket interior 19*b* within which a rod 16 is loosely removably retained.

An important feature of the invention concerns the provision of a channel 20 at lower end, i.e. cap 11, of the bag, and opening longitudinally upwardly toward the upper end of the bag. The channel is shown as annular, and in alignment with the pockets or retainers, so as to readily and easily receive 'blind' insertion of the lower ends 16*a* of the rods 16, to hold them against inward displacement toward the inner zone 14*a*. Thus, the lower ends 16*a* may move to limited extent along the annular length of the channel, as permitted by the looseness of rod retention by the pockets, which adds to the desired flexibility of the bag construction. Channel 20 may simply and advantageously be formed between looping or annular skirt 11*a* and an annular wall 21 integral with cap 11 and upstanding from cap end wall 11*c*. Skirt 11*a* and wall 21 are relatively rigid, and extend concentrically about zone 14*a*.

Also provided are holders removably holding upper ends of the rods to the bag adjacent the upper ends thereof, to in turn retain the rod lower ends 16*a* in channel 20. Such holders, shown at 23, typically have screw threaded attachment with the rods, as via threaded upper ends 16*b* of the rods. Accordingly, the rods may be individually removably attached to the upper cap 12, with which holders 23 may be integral. Note the rod upper end heads 24, grooved at 24*a* to receive a screw driver for tightening the heads against cap shoulders 25. The cap 12 may also have webs 26, 27 and 28 extending across the opening 12*a* defined by the cap, to support different golf club shafts. Holders 23 merge with the ends of certain webs, as for example webs 27 and 28, as shown, whereby the holders are located at 120° spacing.

A bag handle 30 and ball pouch 31 are provided as shown.

I claim:

1. A lightweight reinforced golf bag construction, comprising (a) a longitudinally elongated golf bag having an open upper end, a closed lower end, and a flexible wall extending between said ends and about a hollow interior adapted to receive golf club shafts, (b) multiple rods extending longitudinally between said ends and removably retained by the bag adjacent said wall to resist sideward flexing of the wall, (c) a channel at the closed lower end of the bag and opening longitudinally toward the upper end of the bag, the rod lower ends freely, loosely and blindly received in said channel, and (d) holders removably holding the upper ends of the rods to the bag adjacent the upper end thereof and thereby holding the rod lower ends in said channel, the holders having screw threaded attachment to the rods, (e) said channel being annular and defined by a relatively rigid cap attached to said flexible wall, said cap having an annular upstanding wall directly exposed to the rod lower ends and spaced radially inwardly therefrom, the radial dimension of the channel at the rod locations being greater than the outer diameters of the rod lower ends.

2. The bag construction of claim 1 including at least one longitudinally elongated retainer carried by said wall and within which said rod or rods loosely extend.

3. The bag construction of claim 2 wherein multiple of said retainers have the form of pockets and are at the inner side of said wall.

4. The bag construction of claim 1 wherein said bag upper end is defined by a relatively rigid cap attached to said wall, and carrying said holders.

5. The bag construction of claim 1 wherein the bag lower end cap defines a space radially inwardly of said cap upstanding wall to receive the ends of handles on said golf club shafts and prevent their engagement with said rods.

* * * * *